US012716257B1

(12) United States Patent
Hannah

(10) Patent No.: US 12,716,257 B1
(45) Date of Patent: Aug. 25, 2026

(54) PARKING AID APPARATUS AND METHODS OF USING THE SAME

(71) Applicant: Elbert Hannah, Kildeer, IL (US)

(72) Inventor: Elbert Hannah, Kildeer, IL (US)

(73) Assignee: ParkSimpli Products LLC, Lake Zurich, IL (US)

( * ) Notice: Subject to any disclaimer, the term of this patent is extended or adjusted under 35 U.S.C. 154(b) by 0 days.

(21) Appl. No.: 19/304,324

(22) Filed: Aug. 19, 2025

(51) Int. Cl.
*E04H 6/42* (2006.01)

(52) U.S. Cl.
CPC ..... *E04H 6/426* (2013.01)

(58) Field of Classification Search
CPC ..... E04H 6/426
See application file for complete search history.

(56) References Cited

U.S. PATENT DOCUMENTS 1,871,877 A * 8/1932 Buckman ..... G02B 27/0149 116/246
1,981,188 A * 11/1934 Pavitt ..... G08B 5/02 116/28 R
2,553,963 A * 5/1951 Dzus ..... B62D 15/00 116/28 R
3,261,321 A * 7/1966 Mandl ..... E04H 6/426 116/28 R
3,276,137 A * 10/1966 Lore ..... G01C 17/02 33/355 R
4,813,758 A * 3/1989 Sanders ..... E04H 6/426 116/28 R
4,941,263 A * 7/1990 Hirshberg ..... G02B 27/0101 340/435
6,199,287 B1 * 3/2001 Rankila ..... B60Q 1/48 116/28 R
6,776,117 B2 * 8/2004 D'Onofrio ..... E04H 6/426 116/28 R
9,222,770 B1 * 12/2015 Miller ..... G01C 9/10
10,435,172 B2 * 10/2019 Nour ..... G01C 9/02
2001/0039912 A1 * 11/2001 Sutton ..... B62D 15/00 116/28 R
2025/0101763 A1 * 3/2025 Powers ..... E04H 6/426

* cited by examiner

*Primary Examiner* — Kristina M Deherrera
*Assistant Examiner* — Tania Courson
(74) *Attorney, Agent, or Firm* — Scherrer Patent & Trademark Law, P.C.; Stephen T. Scherrer; Monique A. Morneault

(57) ABSTRACT

Parking aid apparatuses help individuals traverse into a garage space and stop the vehicle precisely where needed to ensure a proper fit within the space. Methods of using the same are further provided.

20 Claims, 5 Drawing Sheets

PARKING AID APPARATUS AND METHODS OF USING THE SAME

TECHNICAL FIELD

The present invention belongs to the field of parking technology, namely aids to help individuals traverse into a garage space and stop the vehicle precisely where needed to ensure a proper fit within the space. Methods of using the same are further provided.

BACKGROUND OF THE INVENTION

Parking a vehicle into a space, whether in a parking lot or a covered space, such as a garage or the like, is often difficult. Indeed, parking is one of the more difficult skills to learn when learning to drive a vehicle, as it requires precise placement of the vehicle within the desired space. Often the space is defined by lines upon into which the vehicle is driven.

When it comes to parking in a garage space, additional complexities become apparent. Specifically, a garage space often requires an even more precise disposition of the vehicle. Not only must a driver drive the vehicle into the relatively narrow space, he or she must do so within walls and a roof. The walls and the roof often make the apparent parking area feel even more narrow and confined. This can lead to increased anxiety and stress about parking.

Moreover, when it comes to parking within a garage space, a person must not only park within a space defined by its horizontal dimension, he or she must also park precisely within a longitudinal dimension as well. For example, driving the car too far forward within a garage space risks hitting objects or even the garage wall in the front of the vehicle. Likewise, failure to sufficiently pull the vehicle into the garage space may cause problems closing the garage door, especially if the vehicle is too close to the garage door or even within the garage door closure area. Typically, garage door's comprise sensors that may prevent a garage door from traversing downwardly when a vehicle is within the garage door closure area. However, if only a portion of the vehicle extends into the garage door closure area, then the vehicle may fail to trip the sensor, which may cause the garage door to close onto the vehicle. This can cause damage to the vehicle, the garage door, or both.

Attempts to solve these problems are often unsatisfactory. For example, one solution involves hanging an object from the ceiling or other structure within the garage space such that once the vehicle arrives at a particular location, the position of the object can often alert the driver that he or she is sufficiently placed within the parking space. Tennis balls hanging from string or artificial bumps on the ground, such as plastic bumps or even 2×4 s, are often used for such a purpose. However, hanging an object or placing an artificial bump in the central space of a garage is often unsightly and still may only provide an approximation to the driver as to where to stop.

Other solutions are often overly technical, such as using laser beams to alert a driver where to stop within a parking space. Not only do laser beams require power, but technical failure of the laser devices often cause problems with parking. For example, if a laser diode fails to receive electricity, such as during a power outage or if a battery dies, has a technical failure within the device itself, or for any other reason, then the laser beam will simply not operate, preventing a user from effectively using it for its intended purpose. Also, laser devices are often expensive to buy, require advanced skills for installation and upkeep, and often do not last.

A need, therefore, exists for an improved parking aid apparatus. Specifically, a need exists for a parking aid apparatus that helps a driver park a vehicle within a parking space. More specifically, a need exists for a parking aid apparatus that helps a driver precisely position a vehicle within the parking space, such as within a garage space. Moreover, a need exists for a parking aid apparatus that allows for adjustments that may be required within garage spaces due to changes to the garage space that may occur over time.

In addition, a need exists for a parking aid apparatus that is simple to install and operate, requiring no more technical knowledge than hanging objects on a wall. Moreover, a need exists for a parking aid apparatus that can be easily tailored and adjusted as needed, such as for different drivers or for different vehicles. In addition, a need exists for a parking aid apparatus that is easy to manufacture, inexpensive for users thereof, and simple to install, operate, and adjust as needed.

SUMMARY OF THE INVENTION

The present invention provides aids to help individuals traverse into a garage space and stop the vehicle precisely where needed to ensure a proper fit within the space. Methods of using the same are further provided.

To this end, in an embodiment of the present invention, a parking aid apparatus is provided. The parking aid apparatus comprises: a bracket configured to be rigidly held against a sidewall of a garage comprising a first leg configured to be disposed adjacent and held to the sidewall and a second leg extending roughly perpendicularly from the first leg; a first vertical line disposed a first distance from a point on the second leg of the bracket; a second vertical line disposed a second distance from the point on the second leg of the bracket, wherein the first vertical line and the second vertical line are offset from one another; and a rotating element at the point on the second leg of the bracket, wherein the rotating element is configured to rotate at least one of the first vertical line and the second vertical line around the point on the second leg of the bracket.

In an embodiment, the first vertical line and the second vertical line are disposed on a housing, wherein a top of the housing is connected to the rotating element.

In an embodiment, the first vertical line is disposed on a front portion of the housing and the second vertical line is disposed on a rear portion of the housing, wherein the rear portion of the housing is disposed toward the first leg of the bracket.

In an embodiment, the rear portion of the housing is opaque.

In an embodiment, the front portion of the housing is transparent.

In an embodiment, the front portion of the housing is transparent and the rear portion of the housing is opaque.

In an embodiment, the second vertical line is a color that contrasts with a color of the rear portion of the housing.

In an embodiment, both the first vertical line and the second vertical line are rotatable about the point on the second leg of the bracket.

In an embodiment, the first vertical line and the second vertical line are independently rotatable about the point on the second leg of the bracket.

In an embodiment, the parking aid apparatus further comprises a panel extending on either side of the second vertical line.

In an embodiment, the second vertical line is a color that contrasts with a color on the panel.

In an embodiment, the first distance and the second distance is the same.

In an alternate embodiment of the present invention, a parking aid apparatus is provided. The parking aid apparatus comprises: a bracket configured to be rigidly held against a sidewall of a garage comprising a first leg configured to be disposed adjacent and held to the sidewall and a second leg extending roughly perpendicularly from the first leg; a first housing rotatably attached to the second leg; a first vertical line on a first side of the first housing, wherein the first side of the first housing is transparent except for the first vertical line; and a second vertical line on a second side of the first housing.

In an embodiment, the parking aid apparatus further comprises: a second housing rotatably attached to the first housing, wherein the second housing comprises a first vertical line on a first side of the second housing, wherein the first side of the second housing is transparent except for the first vertical line, and a second vertical line on a second side of the second housing.

In an embodiment, the parking aid apparatus further comprises: a second housing rotatably attached to the second leg, wherein the second housing comprises a first vertical line on a first side of the second housing, wherein the first side of the second housing is transparent except for the first vertical line and a second vertical line on a second side of the second housing.

In an embodiment, the second side of the first housing is opaque.

In an alternate embodiment of the present invention, a method of using a parking aid apparatus is provided. The method comprises the steps of: providing a bracket configured to be rigidly held against a sidewall of a garage comprising a first leg configured to be disposed adjacent and held to the sidewall and a second leg extending roughly perpendicularly from the first leg, a first vertical line disposed a first distance from a point on the second leg of the bracket; a second vertical line disposed a second distance from the point on the second leg of the bracket, wherein the first vertical line and the second vertical line are offset from one another; and a rotating element at the point on the second leg of the bracket, wherein the rotating element is configured to rotate at least one of the first vertical line and the second vertical line around the point on the second leg of the bracket; attaching the bracket to the sidewall of the garage; and rotating the first vertical line relative to the second vertical line around the point so that the first vertical line and the second vertical line are aligned with each other from a driver's vantage point within a vehicle in the garage when the vehicle is positioned at a parking position within the garage.

In an embodiment, the first vertical line is disposed on a first side of a first housing and the second vertical side is disposed on a second side of the first housing, wherein the first housing is rotatable about the rotating element, further comprising the step of: rotating the first housing to rotate the first vertical line of the first housing relative to the second vertical line of the first housing.

In an embodiment, the first vertical line is disposed on a front portion of the housing and the second vertical line is disposed on a rear portion of the housing, wherein the rear portion of the housing is disposed toward the first leg of the bracket.

In an embodiment, the method of claim further comprises the steps of: providing a second housing rotatably attached to the second leg or the first housing, wherein the second housing comprises a first vertical line on a first side of the second housing, wherein the first side of the second housing is transparent except for the first vertical line, and a second vertical line on a second side of the second housing; and rotating the second housing to rotate the first vertical line of the second housing relative to the second vertical line of the second housing.

It is, therefore, an advantage and objective of the present invention to provide improved parking aid apparatuses.

Specifically, it is an advantage and objective of the present invention to provide parking aid apparatuses that help a driver park a vehicle within a parking space.

More specifically, it is an advantage and objective of the present invention to provide parking aid apparatuses that help a driver precisely position a vehicle within the parking space, such as within a garage space.

Moreover, it is an advantage and objective of the present invention to provide parking aid apparatuses that allow for adjustments that may be required within garage spaces due to changes to the garage space that may occur over time.

In addition, it is an advantage and objective of the present invention to provide parking aid apparatuses that are simple to install and operate, requiring no more technical knowledge than hanging objects on a wall.

Moreover, it is an advantage and objective of the present invention to provide parking aid apparatuses that can be easily tailored and adjusted as needed, such as for different drivers or for different vehicles.

In addition, it is an advantage and objective of the present invention to provide parking aid apparatuses that are easy to manufacture, inexpensive for users to purchase, and simple to install, operate, and adjust as needed.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention provides aids to help individuals traverse into a garage space and stop the vehicle precisely where needed to ensure a proper fit within the space. Methods of using the same are further provided.

Figure 1:
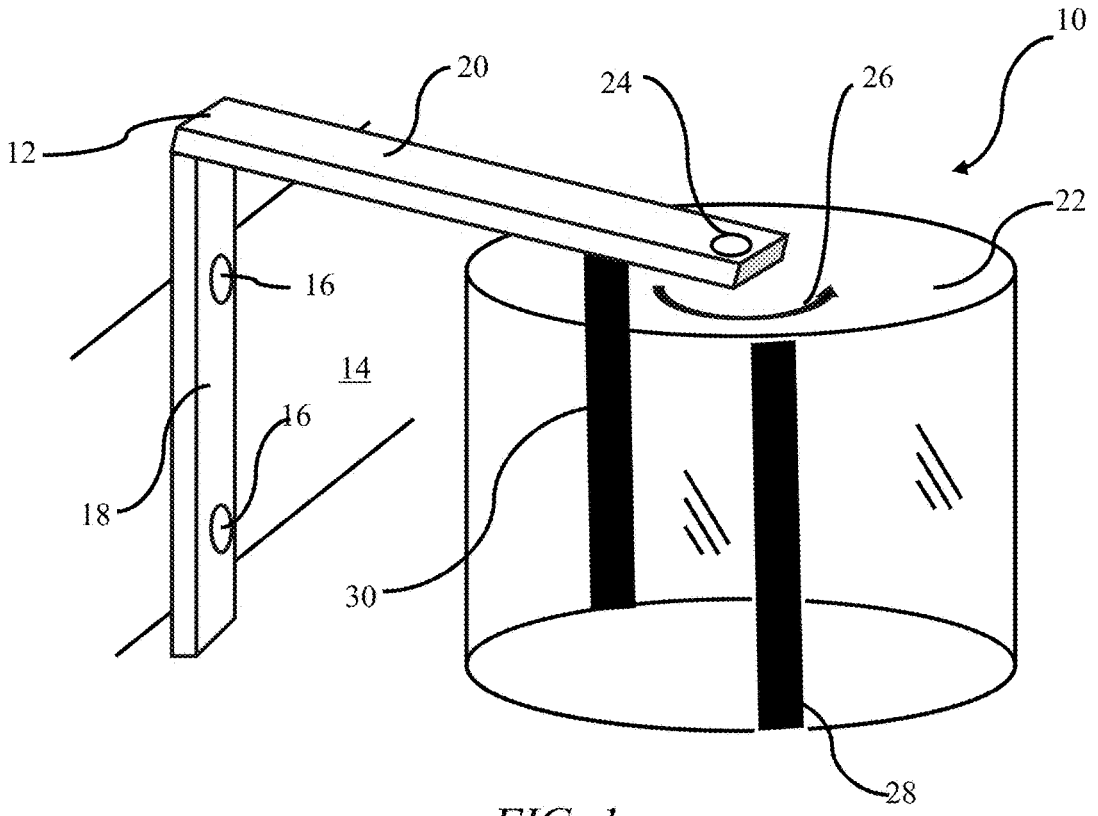
FIG. 1 illustrates a perspective view of a parking aid apparatus in an embodiment of the present invention.

Now referring to the figures, wherein like numerals refer to like parts, FIG. 1 illustrates a parking aid apparatus 10 in an embodiment of the present invention. The parking aid apparatus 10 generally comprises a bracket 12, for mounting the parking aid apparatus on a wall 14 of a garage using screws or bolts 16. The bracket may have a first leg 18 configured to attach to the wall 14 thereof and a second leg 20 extending roughly perpendicularly from the wall 14. Attached to the second leg 20 may be a housing 22 via a bolt, screw, or other attachment means 24 that allows for rotation of the housing 22, as shown by arrow 26. The parking aid apparatus 10 may be mounted to any wall of a garage, or in any other location, such as beneath a cabinet, attached to a shelf, inside a window frame, near a light source, or in any other location on a sidewall of garage that is conspicuous and visible to a driver of a vehicle requiring parking. Moreover, the parking aid apparatus 10 may be mounted on a sidewall of a garage on the driver's side of the vehicle being parked, on the passenger side of the vehicle being parked, or in both locations, as long as the parking aid apparatus 10 is visible to either the driver or another individual within the vehicle who may communicate with the driver when the driver has reached the ideal location within the parking spot, as described herein.

Further, although the housing 22 of the parking aid apparatus 10 is shown as being mounted below the second leg 20, it should be noted that the housing 22 may be mounted above the second leg 20 instead or otherwise attached to the second leg 20 in any configuration.

As shown in FIG. 1, the housing 22 may preferably be cylindrically-shaped, and may further have a first vertical line 28 on a front portion of the housing 22 (the front portion of the housing 22 being opposite the side of the housing 22 closest to where the bracket 12 attaches to the garage wall 14) and a second vertical line 30 on a rear portion of the housing 22 (the rear portion of the housing 22 being opposite the front side of the housing 22). The housing 22 may be fully or partially transparent such that both the first vertical line 28 and the second vertical line 30 are visible from the sides and/or front of the housing 22. To aid in the visibility of the second vertical line 30, the rear portion of the housing 22 may be translucent or opaque, and of a color causing a there to be a high contrast between the color of the rear portion of the housing 22 and the second vertical line 30. Preferably, the rear portion of the housing 22 is opaque white, whereas the second vertical line 30 and/or the first vertical line 28 are black in color. Therefore, both the first and second vertical lines 28, 30 are highly visible, especially from a distance to a driver of a vehicle within the garage.

Figure 2:
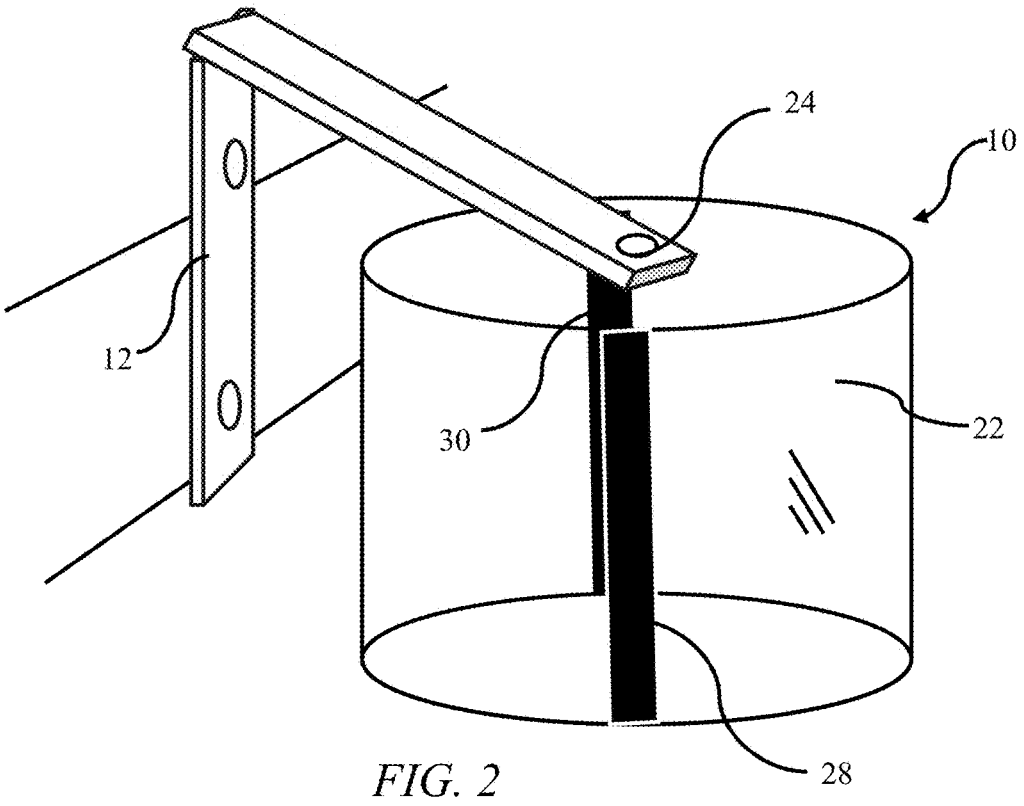
FIG. 2 illustrates an alternate perspective view of a parking aid apparatus in an embodiment of the present invention.

After the bracket is rigidly held against the garage wall 14, the housing 22 may be rotated to aid a driver of a vehicle park the vehicle within the garage space. Specifically, a driver may place the vehicle within the garage at the precise location desired within the garage space, and the housing 22 may be rotated about screw, bolt, or other attachment means 24 so that both the first vertical line 28 and the second vertical line 30 align, as illustrated in FIG. 2, which shows the parking aid apparatus 22 from a different viewable vantage point, such as within a garage space. As shown in FIG. 2, the first vertical line 28 overlaps within the second vertical line 30 so that the first and second vertical lines 28, 30 form a single vertical line from the vantage point of the driver of the vehicle. Thus, the driver of the vehicle can use the alignment of the first and second vertical lines to ensure that the driver stops the vehicle at the desired location when he or she views the housing 22 and sees that the first and second vertical lines 28, 30 are aligned.

Figure 5A:
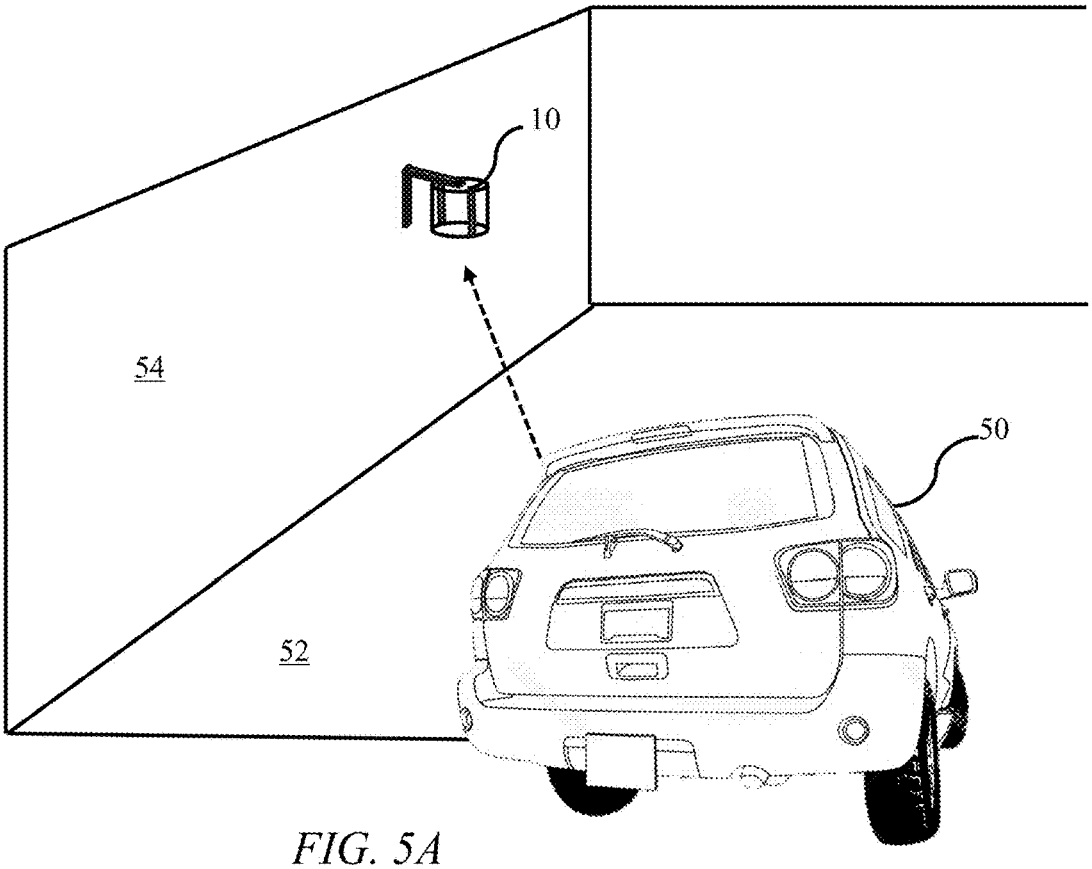
FIGS. 5A and 5B illustrate a parking garage, vehicle, and parking aid apparatus aiding a driver of the vehicle in parking the vehicle within the garage in an embodiment of the present invention.
Figure 5B:
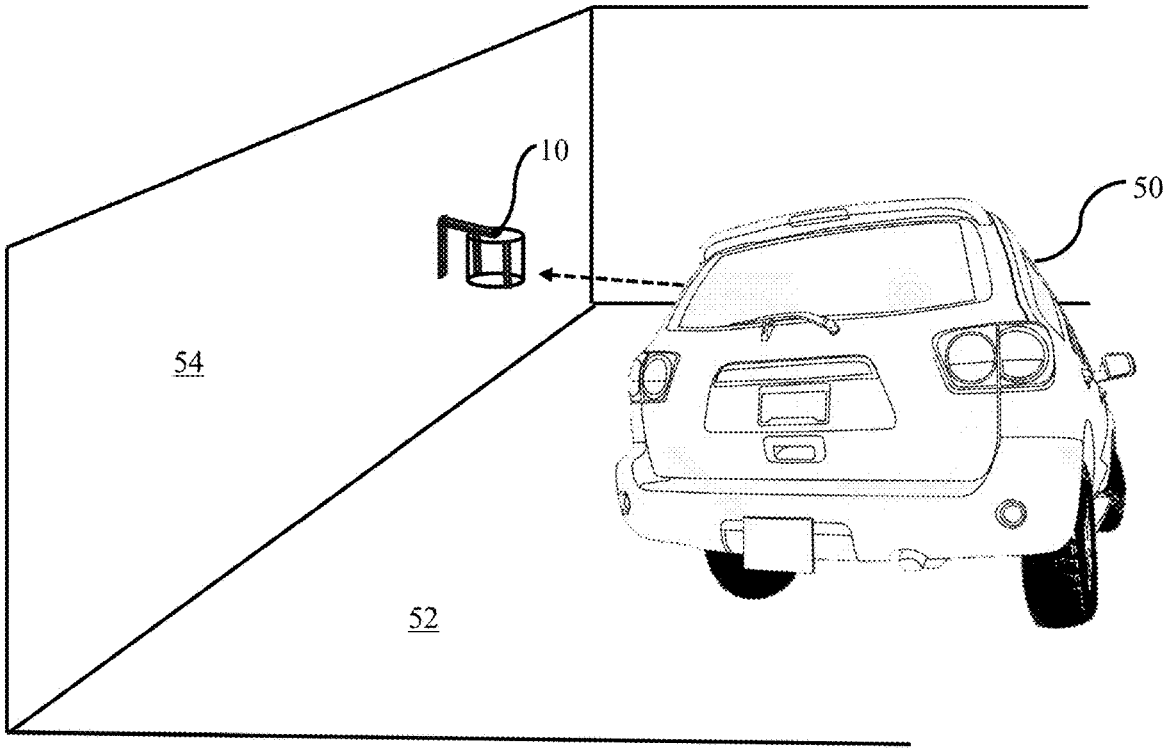

The invention utilizes the "parallax effect" to achieve the precise parking of the vehicle within the garage. Specifically, the parallax effect is the apparent change in position of an object when viewed from different locations. The parallax effect is a perspective effect where objects closer to the viewer seem to move faster or shift more than objects in the background when the viewer's position changes. In the present case, the first vertical line 28 changes or shifts its position faster than the second vertical line 30 as a driver moves the vehicle into the parking space. Therefore, a driver may see the first and second vertical lines 28, 30 misaligned, as illustrated in FIG. 1 and FIG. 5A when starting to pull a vehicle 50 into parking space 52 within garage 54. As the driver gets closer to the desired parking position within the parking space 52, the first and second vertical lines 28, 30 may draw closer together due to the parallax effect. Once aligned, as shown in FIG. 2 and FIG. 5B (from the driver's perspective within the vehicle 50), the driver may know to stop the vehicle 50 as the vehicle 50 would be in the desired location within the parking space 52 of the garage 54.

Because the housing 22 is rotatable, the parking aid apparatus 22 may be precisely positioned easily to aid a user. Specifically, to install and set up the parking aid apparatus 22, the user may simply pick a location on the sidewall 14 of the garage that is easily visible to the driver during the parking process. Then, once rigidly bracketed to the wall 14, the driver may sit within the driver's seat of the vehicle while the vehicle is located in the desired position within the parking space within the parking garage. The housing 22 may simply be rotated, such as, for example, by another individual as the driver is sitting in the driver's seat of the vehicle while the driver is looking at the parking aid apparatus 22 to ensure that the first and second vertical lines are in the perfect position from the point of view of the driver to aid the driver. In addition, because the housing 22 is rotatable, it may be easily adjusted for different drivers, or for different vehicles, or if the vehicle parking must be adjusted due to changes in the parking space of the parking garage, as time goes on.

The parking aid apparatus 10 may be particularly useful for large vehicles that are parked in relatively small spaces, but may be used with any vehicle parked in any space. For example, a small vehicle may be parked in a relatively larger space, where it may be desired that additional open space be provided in front of or behind the vehicle, such as for moving other items into or out of the additional open space, such as lawn mowers or other like objects. Moreover, the parking aid apparatus 10 may also be used in other applications besides being used in parking garages, such as, for example, in parking or aligning boats in docks or piers, or for use in vertical mounting boats or vehicles, such as raising a boat on a lift or mounting a vehicle on a mount, in which case, the apparatus 10 may be turned sideways to accommodate vertical movement of the boat or vehicle.

Figure 3:
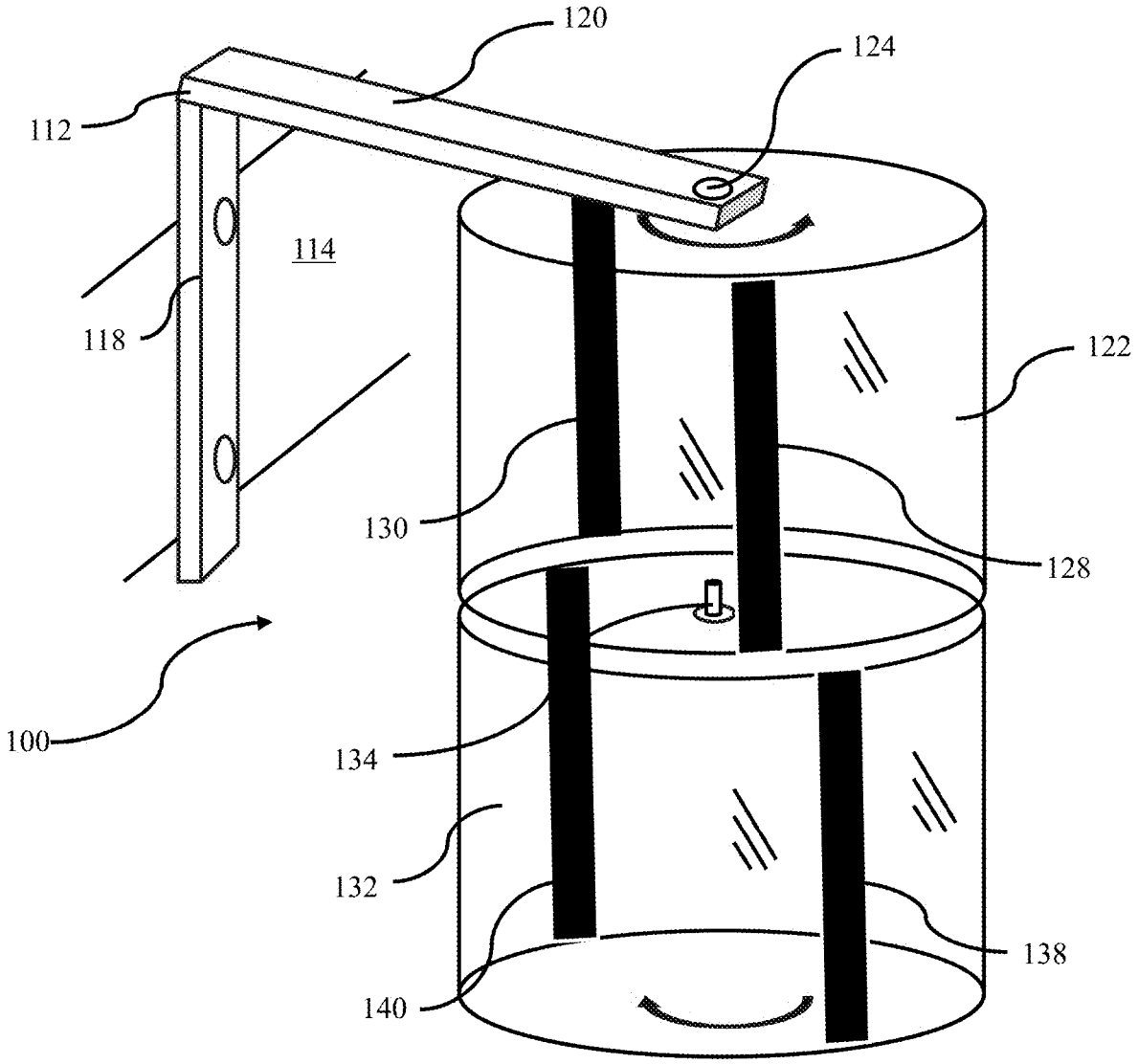
FIG. 3 illustrates a perspective view of a parking aid apparatus in an alternate embodiment of the present invention.

FIG. 3 illustrates an alternate embodiment of the present invention, showing a parking aid apparatus 100 having a bracket 112 having a first leg 118 and a second leg 120 that is substantially similar to the bracket 12 described above, held on a wall 114. A first housing 122 may be rotatably disposed on a screw, bolt, or other attachment means 124. The first housing 122 may have a first vertical line 128 on a front portion of the first housing 122 and a second vertical line 130 on a rear portion of the first housing 122, which may operate substantially similar if not identically to the housing 22 described above.

Rotatably attached to the first housing 122 may be a second housing 132 disposed under the first housing 122 via a screw, bolt, or other attachment means 134. The second housing may further have a first vertical line 138 on a front portion of the second housing 132 and a second vertical line 140 on a rear portion of the second housing 132. The second housing 132 may be fully or partially transparent such that both the first vertical line 138 and the second vertical line 140 are visible from the sides and/or front of the second housing 132. To aid in the visibility of the second vertical line 140, the rear portion of the second housing 132 may be translucent or opaque, and of a color causing a there to be a high contrast between the color of the rear portion of the second housing 132 and the second vertical line 140. Preferably, the rear portion of the second housing 132 is opaque white, whereas the second vertical line 140 and/or the first vertical line 138 are black or other dark color. Therefore, both the first and second vertical lines 138, 140 are highly visible, especially from a distance to a driver of a vehicle within the garage.

Figure 6:
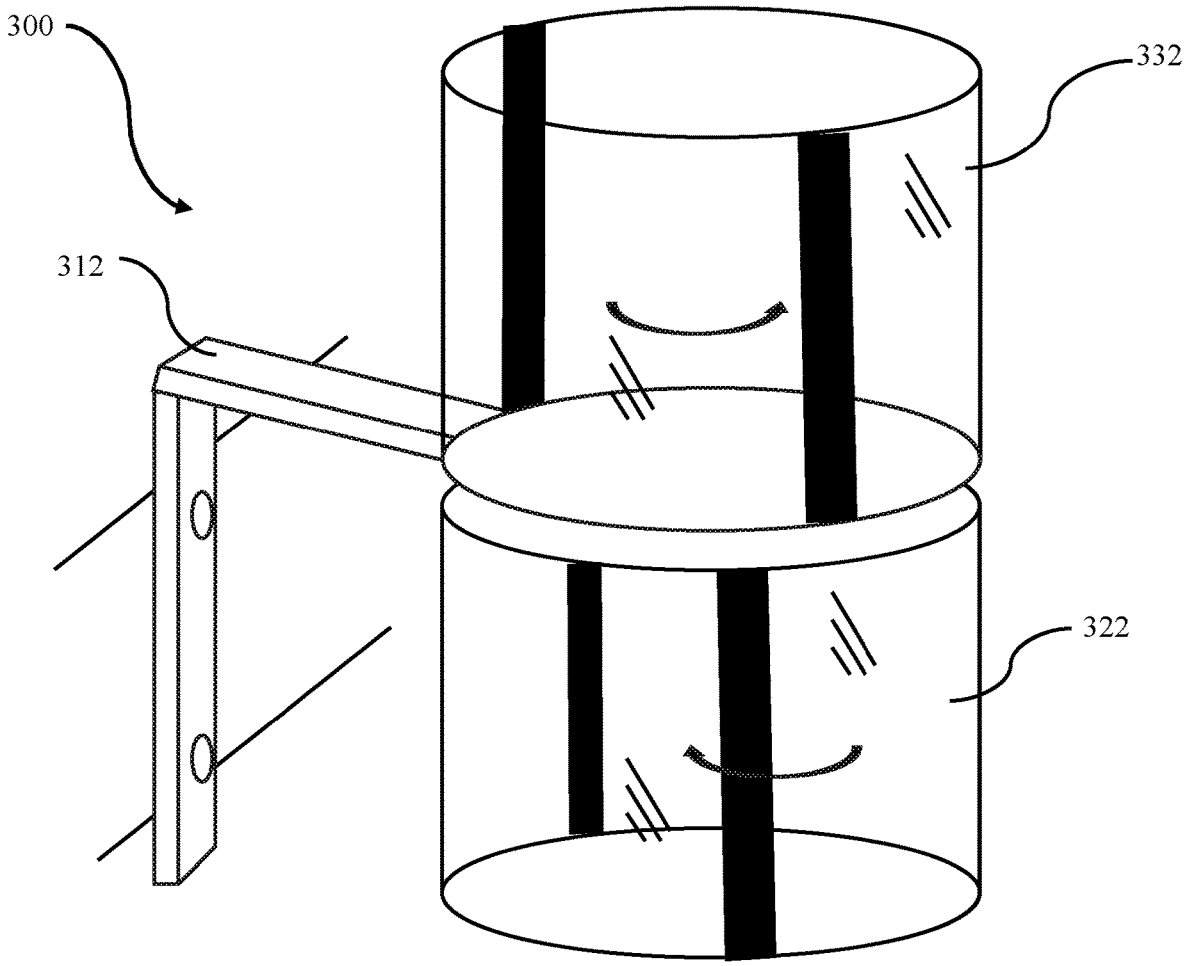
FIG. 6 illustrates a perspective view of a parking aid apparatus in a further alternate embodiment of the present invention.

Although the second housing 132 is shown extending below the first housing 122, with the screw, bolt, or other securing means 134 rotatably connecting the second housing 132 to the first housing 122, it should be noted that the second housing 132 may sit atop the first housing 122, above the second leg 120 so that the second leg sits between the first housing 122 and the second housing 132, as illustrated in FIG. 6, showing a parking aid apparatus 300 having a first housing 322 rotatably attached to and extending beneath bracket 312 and a second housing 332 disposed rotatably attached to and extending above bracket 312. It should also be noted that a third or additional housings, as described herein, may extend from any other housing and be independently rotatable to account for additional rotating positions for additional drivers and/or additional vehicles.

The second housing 132 may be separately and independently rotatable relative to the first housing 122 so that when the first housing 122 is rotated and set at a first position, the second housing 132 may be rotated and set at a second position. The apparatus 100, therefore, may be used to aid more than one driver and/or more than one vehicle in parking the same. Specifically, after the apparatus 100 is disposed on the sidewall of the garage, a first driver may use the first housing 122 to aid in parking a first vehicle. The first driver may use the second housing 132 to aid in parking a second vehicle, or a second driver may use the second housing 132 to aid in parking either the first vehicle or a second, different vehicle.

In the case of parking a single vehicle, a second driver may sit in a position that is different than the first driver or may have a stature that is different than the first drive, which may interfere with the second driver's ability to use the first housing 122 to precisely park the vehicle. Thus, the second housing 132 may be independently rotated to better suit the sitting position or the stature of the second driver.

Likewise, in the case of parking a second, different vehicle, the build of the second vehicle is likely very different than the build of the first vehicle. Moreover, if a second driver drives the second vehicle, then both the build of the second vehicle and the sitting position and/or stature of the second driver may position the second driver very differently compared to the first driver, preventing the second driver from using the first housing 122 to precisely park the second vehicle. Therefore, the second housing 132 may be utilized for the second driver and/or the second vehicle to aid in parking the second vehicle.

Figure 4:
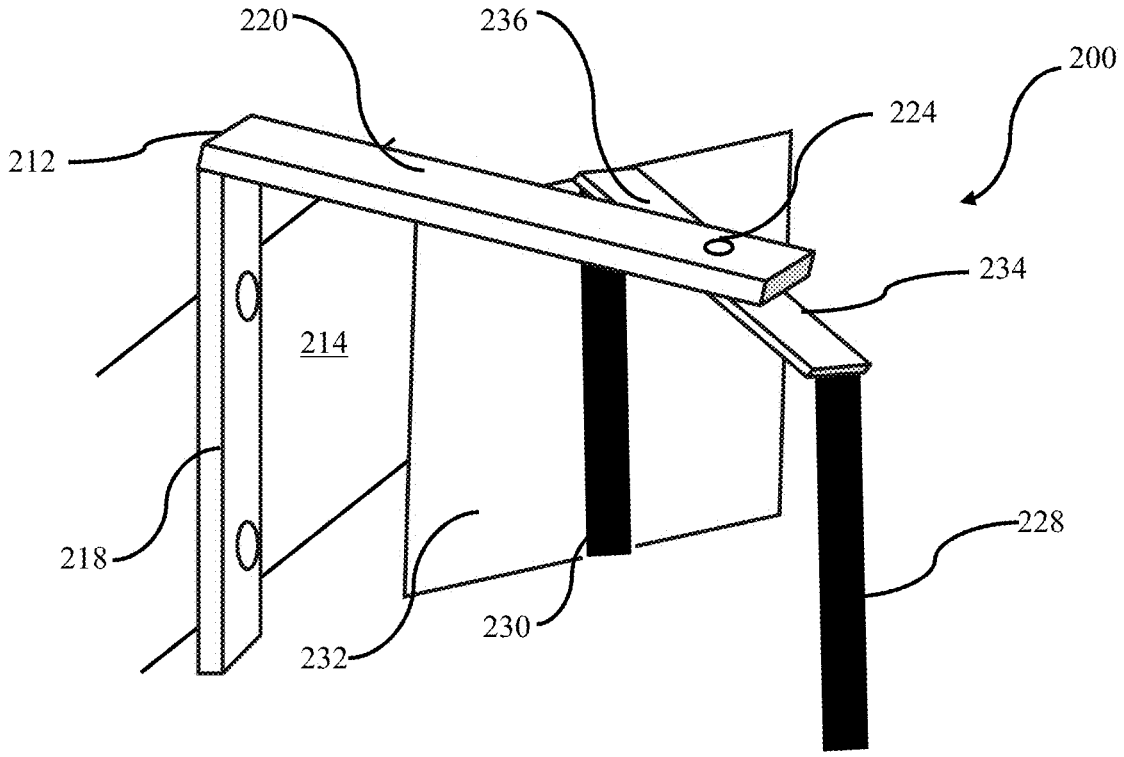
FIG. 4 illustrates a perspective view of a parking aid apparatus in yet another alternate embodiment of the present invention.

FIG. 4 illustrates an alternate embodiment of the present invention of a parking aid apparatus 200 that is functionally similar if not the same as described above with reference to FIGS. 1 and 2. Specifically, the parking aid apparatus 200 aids a driver in precisely parking a vehicle without any housing. Specifically, a bracket 212 may be disposed on a wall 214, the bracket 212 having a vertical leg 218 and a roughly perpendicular leg 220 extending therefrom. Attached on an end of the perpendicular leg 220 may be one or more extensions 234, 236 that may extend from a screw, bolt, or other securing means 224 that allows the extensions 234, 236 to rotate thereabout. The extensions 234, 236 may be the two halves of a single bar, wherein rotating the same about the screw, bolt, or other securing means 224 rotates both extensions 234, 236 at the same time in opposite directions. Alternatively, extensions 234, 236 may be separate from one another, such that each extension 234, 236 may be positioned as desired.

A first vertical line 228 may extend from the first extension 234 and a second vertical line 230 may extend from the second extension 236. The two vertical lines may be utilized by a driver to use the parallax effect to aid in parking a vehicle. A card or panel 232 of a color contrasting with the color of the second vertical line 230 may be placed with the second vertical line 230 to aid the driver in viewing the second vertical line 230, especially relative to the first vertical line 228.

For the embodiments described herein, other features may be utilized to enhance the usability of the parking aid apparatuses. For example, the rotation of the housings or extensions, as described herein, may be done manually or via remote control. In addition, there may be lights associated with the apparatuses that provide drivers with better visibility. The lights may, for example, aid in providing contrast between the vertical lines and the opaque portions of the housings or the card or panel. Moreover, each bracket may be configured in any manner allowing the apparatuses to be useful against a sidewall of a garage. Specifically, the perpendicular leg may extend from a bottom of the vertical leg, instead of the top thereof as shown in the figures. It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. A parking aid apparatus comprising:

a bracket configured to be rigidly held against a sidewall of a garage comprising a first leg configured to be disposed adjacent and held to the sidewall and a second leg extending roughly perpendicularly from the first leg;

a first vertical line disposed a first distance from a point on the second leg of the bracket;

a second vertical line disposed a second distance from the point on the second leg of the bracket, wherein the first vertical line and the second vertical line are offset from one another; and a rotating element at the point on the second leg of the bracket, wherein the rotating element is configured to rotate at least one of the first vertical line and the second vertical line around the point on the second leg of the bracket.

2. The parking aid apparatus of claim 1 wherein the first vertical line and the second vertical line are disposed on a housing, wherein a top of the housing is connected to the rotating element.

3. The parking aid apparatus of claim 1 wherein both the first vertical line and the second vertical line are rotatable about the point on the second leg of the bracket.

4. The parking aid apparatus of claim 1 wherein the first vertical line and the second vertical line are independently rotatable about the point on the second leg of the bracket.

5. The parking aid apparatus of claim 1 wherein the first distance and the second distance is the same.

6. The parking aid apparatus of claim 1 further comprising:

a panel extending on either side of the second vertical line.

7. The parking aid apparatus of claim 6 wherein the second vertical line is a color that contrasts with a color on the panel.

8. The parking aid apparatus of claim 1 wherein the first vertical line is disposed on a front portion of the housing and the second vertical line is disposed on a rear portion of the housing, wherein the rear portion of the housing is disposed toward the first leg of the bracket.

9. The parking aid apparatus of claim 8 wherein the rear portion of the housing is opaque.

10. The parking aid apparatus of claim 8 wherein the front portion of the housing is transparent.

11. The parking aid apparatus of claim 8 wherein the front portion of the housing is transparent and the rear portion of the housing is opaque.

12. The parking aid apparatus of claim 8 wherein the second vertical line is a color that contrasts with a color of the rear portion of the housing.

13. A parking aid apparatus comprising:

a bracket configured to be rigidly held against a sidewall of a garage comprising a first leg configured to be disposed adjacent and held to the sidewall and a second leg extending roughly perpendicularly from the first leg;

a first housing rotatably attached to the second leg;

a first vertical line on a first side of the first housing, wherein the first side of the first housing is transparent except for the first vertical line; and a second vertical line on a second side of the first housing.

14. The parking aid apparatus of claim 13 further comprising:

a second housing rotatably attached to the first housing, wherein the second housing comprises a first vertical line on a first side of the second housing, wherein the first side of the second housing is transparent except for the first vertical line, and a second vertical line on a second side of the second housing.

15. The parking aid apparatus of claim 13 further comprising:

a second housing rotatably attached to the second leg, wherein the second housing comprises a first vertical line on a first side of the second housing, wherein the first side of the second housing is transparent except for the first vertical line and a second vertical line on a second side of the second housing.

16. The parking aid apparatus of claim 13 wherein the second side of the first housing is opaque.

17. A method of using a parking aid apparatus comprising the steps of:

providing a bracket configured to be rigidly held against a sidewall of a garage comprising a first leg configured to be disposed adjacent and held to the sidewall and a second leg extending roughly perpendicularly from the first leg, a first vertical line disposed a first distance from a point on the second leg of the bracket; a second vertical line disposed a second distance from the point on the second leg of the bracket, wherein the first vertical line and the second vertical line are offset from one another; and a rotating element at the point on the second leg of the bracket, wherein the rotating element is configured to rotate at least one of the first vertical line and the second vertical line around the point on the second leg of the bracket;

attaching the bracket to the sidewall of the garage;

rotating the first vertical line relative to the second vertical line around the point so that the first vertical line and the second vertical line are aligned with each other from a driver's vantage point within a vehicle in the garage when the vehicle is positioned at a parking position within the garage.

18. The method of claim 17 wherein the first vertical line is disposed on a first side of a first housing and the second vertical side is disposed on a second side of the first housing, wherein the first housing is rotatable about the rotating element, further comprising the step of:

rotating the first housing to rotate the first vertical line of the first housing relative to the second vertical line of the first housing.

19. The method of claim 18 wherein the first vertical line is disposed on a front portion of the housing and the second vertical line is disposed on a rear portion of the housing, wherein the rear portion of the housing is disposed toward the first leg of the bracket.

20. The method of claim 18 further comprising the steps of:

providing a second housing rotatably attached to the second leg or the first housing, wherein the second housing comprises a first vertical line on a first side of the second housing, wherein the first side of the second housing is transparent except for the first vertical line, and a second vertical line on a second side of the second housing; and rotating the second housing to rotate the first vertical line of the second housing relative to the second vertical line of the second housing.

* * * * *